US006912981B2

(12) United States Patent
Davis et al.

(10) Patent No.: US 6,912,981 B2
(45) Date of Patent: Jul. 5, 2005

(54) METHOD AND APPARATUS TO CORRECT A CAM PHASER FAULT

(75) Inventors: Jason Thomas Davis, Williamston, MI (US); Timothy J. Braman, Williamston, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/225,452

(22) Filed: Aug. 21, 2002

(65) Prior Publication Data

US 2004/0035380 A1 Feb. 26, 2004

(51) Int. Cl.[7] ..... F01L 9/02

(52) U.S. Cl. ..... 123/90.12; 123/90.16; 464/160

(58) Field of Search ..... 123/90.15, 90.16, 123/90.17, 90.12, 90.1, 90.18, 90.27, 90.31; 464/1, 2, 160, 161; 137/242; 251/12

(56) References Cited

U.S. PATENT DOCUMENTS 4,941,445 A * 7/1990 Deutsch ..... 123/406.18
5,218,935 A * 6/1993 Quinn et al. ..... 123/90.17
5,363,817 A * 11/1994 Ikeda et al. ..... 123/90.15
5,417,187 A * 5/1995 Meyer et al. ..... 123/90.17
5,626,108 A * 5/1997 Kato et al. ..... 123/90.15
5,630,396 A * 5/1997 Fukui et al. ..... 123/406.18
5,715,779 A * 2/1998 Kato et al. ..... 123/90.15
5,937,806 A * 8/1999 Lyko et al. ..... 123/90.15
5,979,378 A * 11/1999 Matsuno et al. ..... 123/90.15
6,085,706 A * 7/2000 Kadowaki et al. ..... 123/90.15
6,170,446 B1 * 1/2001 Hashimoto ..... 123/90.15
6,260,524 B1 * 7/2001 Wachi ..... 123/90.15
6,330,869 B1 * 12/2001 Yoshiki et al. ..... 123/90.15
6,401,675 B1 * 6/2002 Nakamura et al. ..... 123/90.15
6,405,697 B2 * 6/2002 Mikame ..... 123/90.18
6,488,008 B1 * 12/2002 Jankovic et al. ..... 123/399
6,513,469 B2 * 2/2003 Nakamura et al. ..... 123/90.15

* cited by examiner

*Primary Examiner*—Thomas Denion
*Assistant Examiner*—Ching Chang
(74) *Attorney, Agent, or Firm*—Christopher DeVries

(57) ABSTRACT

A method of correcting a cam phaser system failure including detecting a cam phaser system fault and generating a control signal to correct said cam phaser system fault.

9 Claims, 4 Drawing Sheets

METHOD AND APPARATUS TO CORRECT A CAM PHASER FAULT

TECHNICAL FIELD

The present invention relates to the control of a cam phaser used in an internal combustion engine. More specifically, the present invention relates to a method and apparatus for detecting and correcting a cam phaser or cam phaser solenoid fault.

BACKGROUND OF THE INVENTION

A cam phaser is a device to create a variable rotational offset between the exhaust camshaft, intake camshaft and crankshaft of an internal combustion engine (ICE). The degree of rotational offset generated by a cam phaser enables the ICE to be tuned for specific performance requirements by varying valve overlap, i.e., overlap between the exhaust and intake valves of an ICE. In applications where idle quality is important, a relatively small degree of valve overlap is desired. In applications where it is required that NOx components are reduced, a relatively large amount of overlap is desired. The cam phaser provides charge dilution in the form of recirculated exhaust gases. Charge dilution is a method of adding inert substance to the air/fuel mixture in a cylinder of an ICE to decrease the heat capacity of the air/fuel mixture and thus reduce the amount of NOx components.

SUMMARY OF THE INVENTION

The present invention relates to a method and apparatus for detecting a faulted cam phaser and correcting the fault. The cam phaser in the present invention is a hydraulic continuously variable cam phaser coupled to the exhaust valve cam shaft of an overhead cam ICE, but any engine configuration is considered within the scope of the present invention. In alternate embodiments of the present invention, the cam phaser may be coupled to the intake valve camshaft. The cam phaser position is controlled by a pulse width modulated solenoid valve controlling the hydraulic fluid (oil) flow to an adjusting piston. The oil pressure acts in concert with a spring pushing the adjusting piston with a force that opposes the oil pressure. The combination of oil pressure and flow acting against the spring force positions the cam phaser, placing a camshaft and its associated valves in a desired position.

During certain operating conditions, a hydraulic cam phaser may be unable to maintain its commanded position due to debris in the oil jamming the solenoid armature or other similar conditions. Debris in the oil can prevent modulation of fluid flow to and from the cam phaser, preventing closed loop control of the cam phaser.

The present invention includes a method and apparatus to determine when the cam phaser solenoid is stuck or jammed in position and a method and apparatus to release or unstick the cam phaser solenoid.

DESCRIPTION OF THE PREFERRED EMBODIMENT

Figure 1:
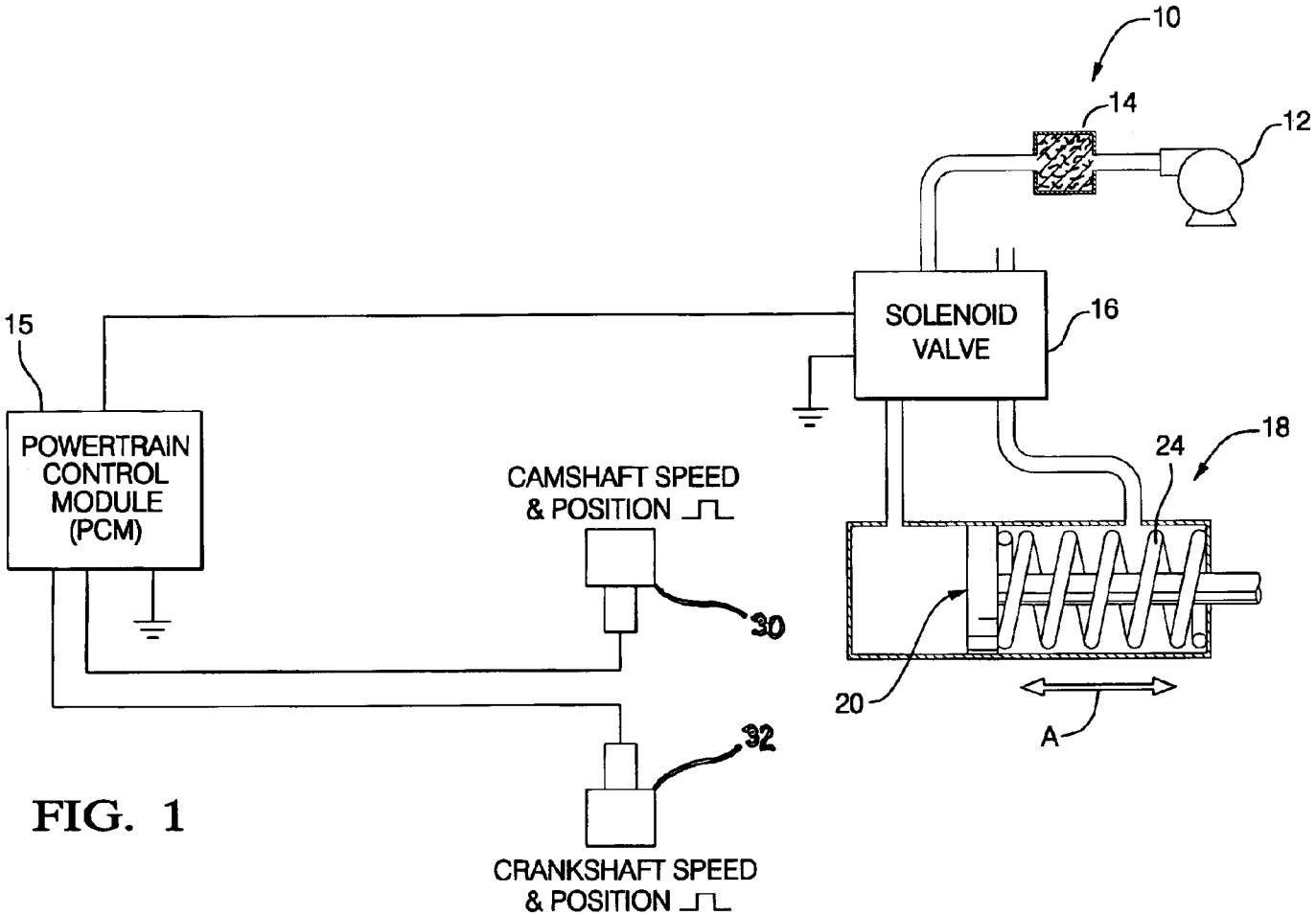
FIG. 1 is a diagrammatic drawing of a preferred cam phaser system of the present invention.

FIG. 1 is a diagrammatic drawing of a cam phaser system 10 of the present invention. The cam phaser system 10 is provided with pressurized hydraulic fluid such as oil by an oil pump 12 and an oil filter 14. A four-way solenoid valve 16 controls the oil flow to a cam phaser 18. The solenoid valve 16 is controlled by a powertrain control module 15 to pulse width modulate (PWM) the four-way valve 16. The cam phaser 18 is coupled between a camshaft sprocket and the end of the camshaft. The camshaft sprocket is coupled to the crankshaft, as is commonly known in the art.

The cam phaser 18 includes a piston 20 and spring 24 that are acted upon by oil pressure to move the piston 20 in the directions of arrow A. The sliding piston 20 will rotate sliding helical gears on the sprocket and camshaft to rotate the camshaft relative to the cam shaft sprocket and produce the variable cam phaser functionality of the present invention. Oil pressure and flow is provided via the solenoid valve 16 to act upon both sides of the piston 20. The spring 24 opposes movement of the piston 20 in one direction. The movement of the piston 20, and thus the cam phaser 18, will be controlled by the oil flow to either side of the piston 20. The camshaft further includes target wheel and sensors 30, 32 to detect the speed and position of the camshaft and/or crankshaft and provide feedback for a camshaft position algorithm.

The amount of oil flow to the piston 20 is controlled by the modulation of the solenoid valve 16. The powertrain controller 15 controls the duty cycle of the solenoid valve 16 to generate the desired position of the piston 20 and thus the cam phaser 18. In certain situations, debris in the oil may restrict the solenoid valve 16, preventing the modulation of oil flow through the solenoid. Depending on operating conditions, the inability to modulate oil flow will result in uncontrolled movement of the cam phaser 18, or inability to move the cam phaser 18. The method and apparatus of the present invention will detect this jammed condition and generate a control current of cyclic output to the solenoid valve 16 to jar the debris loose and release the solenoid 16.

Figure 2:
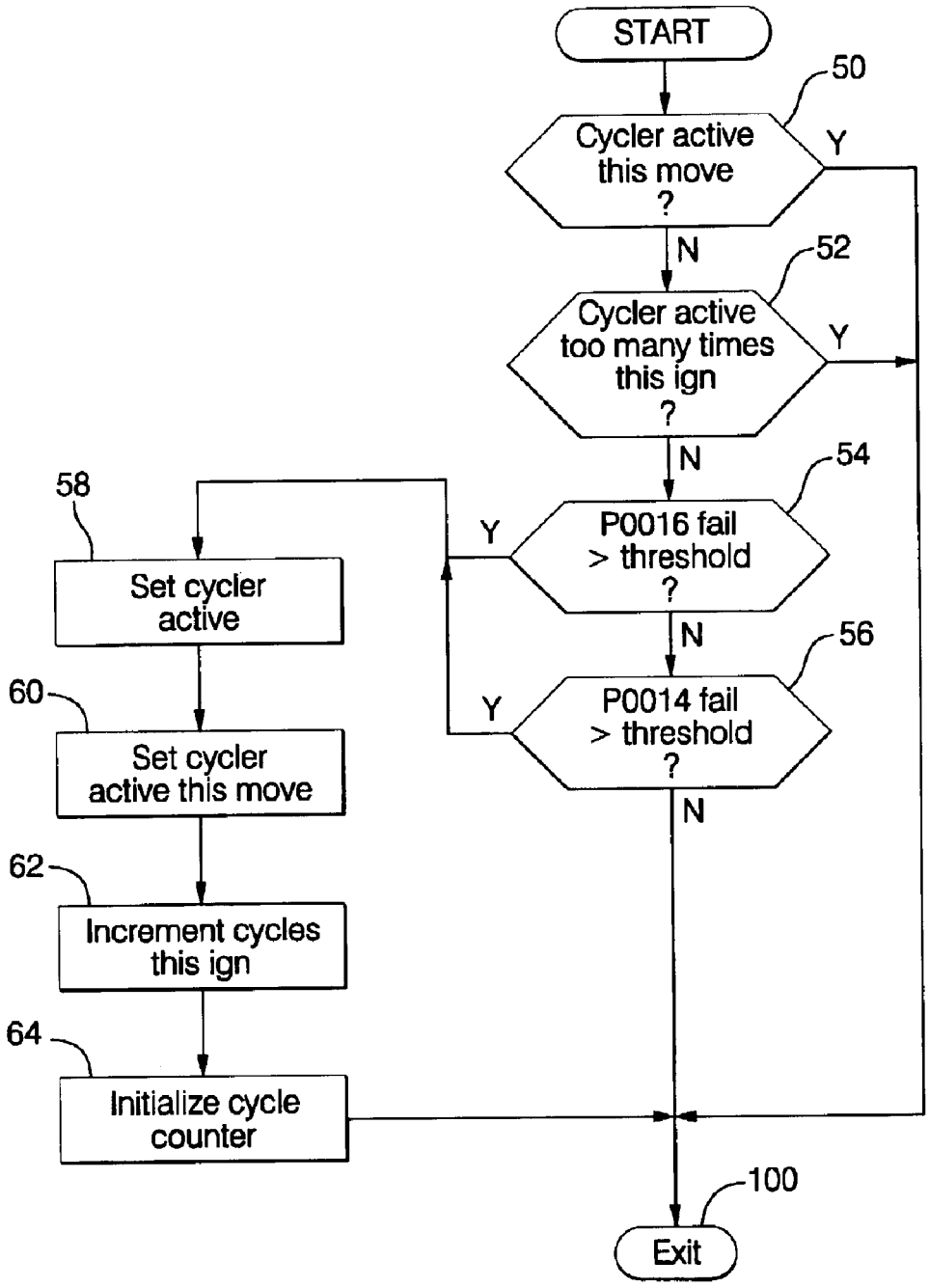
FIG. 2 is a flow chart of a preferred solenoid release detection method of the present invention.
Figure 3:
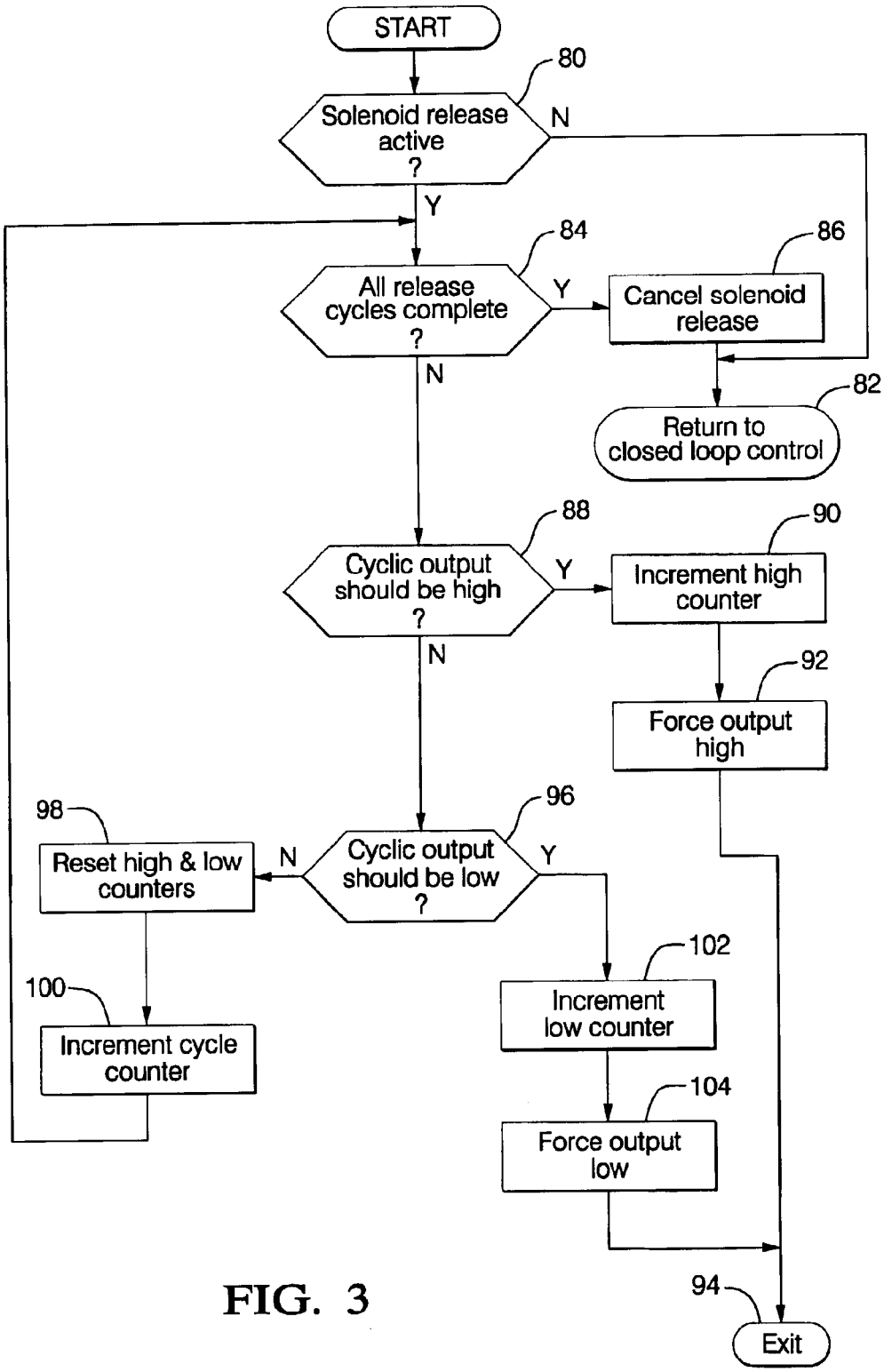
FIG. 3 is a flow chart of a preferred solenoid release output control method of the present invention.
Figure 4:
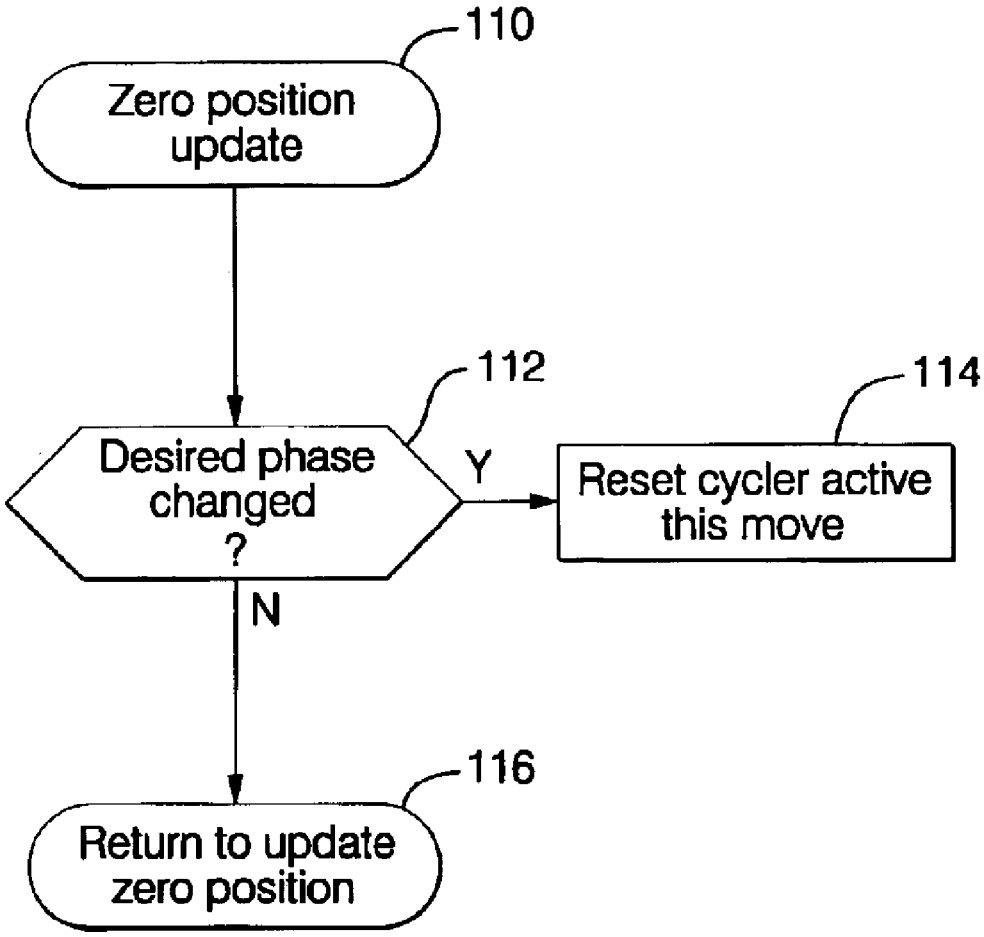
FIG. 4 is a flow chart of a preferred solenoid release active move reset method of the present invention.

FIGS. 2, 3 and 4 are flowcharts of preferred methods of the present invention. As the cam phaser 18 velocity and direction are related to solenoid position, and since the solenoid 16 can stick in any position, cam phase angle is difficult to use as an indication of a sticking solenoid. The present invention uses error counts (time) of two cam phase angle correlation diagnostic to determine if the solenoid 16 is stuck or jammed. Once this determination has been made, the controller 15 will apply a cyclic current output to the solenoid 16 to allow the debris or other sticking conditions to be released. The output is preferably applied at a rate that prevents the cam phaser 18 from responding to the cyclic current output once the solenoid 16 has been released. The parameters of the cyclic output are preferably calibrated to ensure that enough force can be applied to release the solenoid 16, while keeping the frequency high enough to prevent the cam phaser 18 from responding and creating another position error.

FIG. 2 is a flow chaff of a preferred solenoid release detection method of the present invention. The software routine of the present invention at block 50 determines if the controller 15 has provided a cyclic current output to the solenoid 16 to unstick the solenoid 16 at the current commanded cam phaser 18 position. This determination is made by checking the flag set at block 50. The application of cyclic current to the solenoid 16 by the controller 15 will be termed as the "cycler" routine. The cycler routine may be executed only once per cam phaser 18 move. If the cycler has been active this cam phaser 18 move, then the routine will exit at block 100. If the cyclor has not been active as this commanded cam phaser 18 position, the routine will continue to block 52 to determine if the cycler has been activated more than a certain calibrated number of times in this ignition cycle. If the cycler has been active more than the calibrated number of times in this ignition cycle, then the routine will exit at block 100 to allow the diagnostic to complete and indicate that there is a mechanical or engine problem. If the cycler has not been active more than the calibrated number of times in this ignition cycle, the routine will continue to block 54.

Block 54 represents a diagnostics routine (P0016) to detect a cam phaser 18 home position fault. The P0016 diagnostic runs when the cam phaser 18 is commanded to its home (fully advanced) position. The diagnostic compares the current position of the cam phaser 18 to its design intent home position. If these positions vary by more than a calibrated amount, the cam phaser is determined to be stuck and the P0016 diagnostic failure counter (timer) will increment. If the condition remains for a calibrated amount of time, the diagnostic will log a failure of this condition in the controller 15 and will disable the operation of the cam phaser 18. The P0016 diagnostic is determined to have been passed (i.e., diagnostic indicates no faults) when the current cam phaser 18 position is within a calibrated range of the design intent home position for a calibrated amount of time. If a cam phaser 18 fault has been detected by block 54, the routine will continue to block 58.

The fault detection at block 54 occurs at a lower calibrated time, than failure of the P0016 diagnostic, and therefore before a cam phaser 18 fault is logged or cam phasing is disabled. If a cam phaser 18 fault has not been detected at block 54, the routine will continue to block 56 having a second diagnostics routine (P0014). The P0014 diagnostic runs when the cam phaser 18 is commanded to any position other than its home (fully advanced) position. The diagnostic compares the current position of the cam phaser 18 to its commanded position. If these positions vary by more than a calibrated amount, the cam phaser is determined to be faulted and the P0014 diagnostic failure counter (timer) will increment. If the condition remains for a calibrated amount of time, the diagnostic will log a failure of this condition in the controller 15 and will disable operation of the cam phaser 18. The P0014 diagnostic is determined to have passed when the current cam phaser 18 position is within a calibrated range of the commanded cam phaser 18 position for a calibrated amount of time. If no cam phaser fault is detected at block 56, the routine will end at block 100. If a cam phaser fault has been detected at block 56, the routine will continue to block 58. The fault detection at block 56 occurs at a lower calibrated time, than failure of the P0014 diagnostic, and therefore before a cam phaser 18 fault is logged before cam phasing is disabled.

The routine, at block 58, sets a flag to indicate that the cyclic output should be enabled and continues to block 60 to set a flag indicating that the cycler has been activated at this commanded cam phaser 18 position. The flag set at block 60 will prevent the cycler from being activated again until the cam phaser 18 is commanded to a new position. Continuing to block 62, the routine increments a first counter that indicates how many times the cycler has been activated in this specific ignition cycle. The cycle counter at block 64 is initialized to allow the cycler to perform a calibrated number of square wave PWM cycles to release the sticking solenoid 16.

Once a cam phaser fault has been detected by the algorithm in FIG. 2, the software routine to release the solenoid 16 is activated. FIG. 3 is a flow chart of a preferred solenoid release control software routine of the present invention. Starting at block 80, the routine will determine if the solenoid release routine should be active. The flag set at block 58 will indicate if the solenoid release routine should be active. If the flag has not been set, the routine will return to normal closed loop control for the cam phaser 18 at block 82. Block 84 determines if the number of release cycles or current pulses initialized to a calibrated value at 64 have been completed, as determined by a first counter. The first counter indicates the number of square wave PWM output cycles remaining to be completed by the cycler. If the calibrated number of square wave PWM cycles are complete as indicated by the first counter being zero, then the solenoid release routine will be stopped at block 86 by clearing the flag set at block 58 and checked at block 80, and the cam phaser 18 will be returned to normal closed loop control at block 82.

Continuing to block 88, when the release cycles have not been completed, block 88 determines if the output of the controller ("control signal ") to tile solenoid 16 should be in a high or on position for the current output cycle. This determination is made by comparing a second counter to a calibrated desired high time. If the control signal should be high, then the second counter is incremented at block 90 and the control signal is forced to a high condition for the current output cycle at block 92. The routine then exits at block 94. If the controller determines that the control signal for the current output cycle should not be high, the routine continues to block 96. Block 96 determines if the control signal should be low or off. This determination is made by comparing a third counter to a calibrated desired low time. If the control signal should not be low, the second and third counters are reset at block 98 and the first counter is incremented at block 100. The routine will then continue to block 84.

If the controller determines that the control signal should be low at block 96, the third counter will be incremented at block 102 and the control signal will be forced to a low condition for the current output cycle at block 104. The routine will then exit at block 94. The routine of FIG. 3 will thus modulate a control signal to the solenoid that will be held high and low for a certain calibrated amount of time and a certain calibrated number of cycles to release the solenoid 16 from a jammed or stuck condition.

FIG. 4 is a flow chart of a preferred routine to clear the flag that indicates that the cycler has been active at the current desired cam phaser 18 position of the present invention. The routine starts at block 110. At block 112, the routine determines if the commanded cam phaser 18 position has changed. This determination is made by comparing the current commanded position to the previous commanded position. If the commanded position has changed, execution continues at block 114. The flag to indicate that the cycler has been active at the current commanded cam phaser 18 position is cleared at block 114. This action allows the cycler to be made active again at the current commanded cam phase position if necessary. This flag is checked at block 60 in FIG. 2. If the commanded cam phaser 18 position has not changed from the previous position, as determined in block 112, the routine exits at block 116.

While this invention has been described in terms of some specific embodiments, it will be appreciated that other forms can readily be adapted by one skilled in the art. Accordingly, the scope of this invention is to be considered limited only by the following claims.

What is claimed is:

1. A method of correcting a cam phaser system failure comprising:

detecting a cam phaser system fault in a hydraulic cam phaser system having a solenoid valve; and determining if the cam phaser fault is caused by a blockage in the solenoid valve supplying hydraulic fluid to the cam phaser; and generating a control signal to the solenoid valve to release the blockage.

2. The method of claim 1 wherein the step of generating a control signal comprises generating a current signal to the solenoid valve to correct the cam phaser fault.

3. A method of detecting a fault on camshaft position in an internal combustion engine comprising:

providing a hydraulically-actuated cam phaser coupled to the camshaft;

providing a controller to control the position of the cam phaser;

detecting a hydraulic flow fault for the cam phaser;

generating a control signal to the cam phaser to correct said hydraulic flow fault determining if the hydraulic flow fault is a fault caused by a blockage in a solenoid valve supplying hydraulic fluid to the cam phaser; and wherein generating a control signal to the cam phaser comprises generating a control signal to the solenoid valve to release the blockage.

4. A cam phaser system comprising:

a hydraulically cam phaser;

a solenoid providing a flow of pressurized oil to said hydraulically-actuated cam phaser;

a controller for providing a control signal to said solenoid; and wherein said controller determines if a hydraulic fault caused by a blockage has occurred with said solenoid and wherein said controller provides a control signal to said solenoid to release said blockage.

5. The cam phaser system of claim 4 wherein said control signal is a cyclic current that does not affect the position of said cam phaser.

6. The cam phaser system of claim 4 wherein said cam phaser is coupled to an exhaust camshaft.

7. The cam phaser system of claim 4 wherein said cam phaser is coupled to an intake cam shaft.

8. The cam phaser system of claim 4 wherein said cam phaser system is coupled to an internal combustion engine with an overhead cam configuration.

9. The cam phaser system of claim 4 wherein said cam phaser includes camshaft position feedback for said controller.

* * * * *